United States Patent [19]

Comeau

[11] Patent Number: 4,619,305

[45] Date of Patent: Oct. 28, 1986

[54] SEMI-ADJUSTABLE SHADE AND ROLLER COMBINATION

[75] Inventor: Paul E. Comeau, Warwick, R.I.

[73] Assignee: Kenney Manufacturing Company, Warwick, R.I.

[21] Appl. No.: 715,390

[22] Filed: Mar. 25, 1985

[51] Int. Cl.[4] ..... A47G 5/02

[52] U.S. Cl. ..... 160/263

[58] Field of Search ..... 160/263

[56] References Cited

U.S. PATENT DOCUMENTS

| | | | |
|---|---|---|---|
| 52,296 | 1/1866 | Lamberson et al. | 160/263 |
| 3,299,944 | 1/1967 | Gossling et al. | 160/263 |
| 4,006,770 | 2/1977 | Ferguson | 160/263 |

FOREIGN PATENT DOCUMENTS

| | | | |
|---|---|---|---|
| 2051936 | 1/1981 | United Kingdom | 160/263 |

*Primary Examiner*—Ramon S. Britts
*Assistant Examiner*—Cherney S. Lieberman
*Attorney, Agent, or Firm*—Russell & Tucker

[57] ABSTRACT

A semi-adjustable shade and roller combination is provided in which an essentially non-stretchable shade material is mounted on a telescoping roller made up of an outer roller and an inner roller with the shade secured to the outer roller, and the inner roller having a split plastic sleeve over it to make up for the difference in outside diameter between the inner and outer rollers, the inner roller having an enlarged flanged head.

4 Claims, 10 Drawing Figures

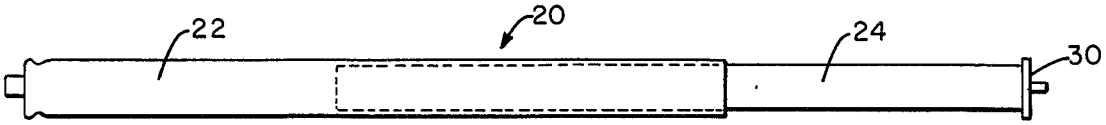
FIG. 1
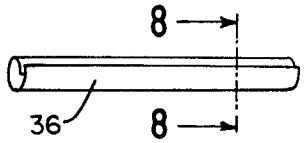
FIG. 2
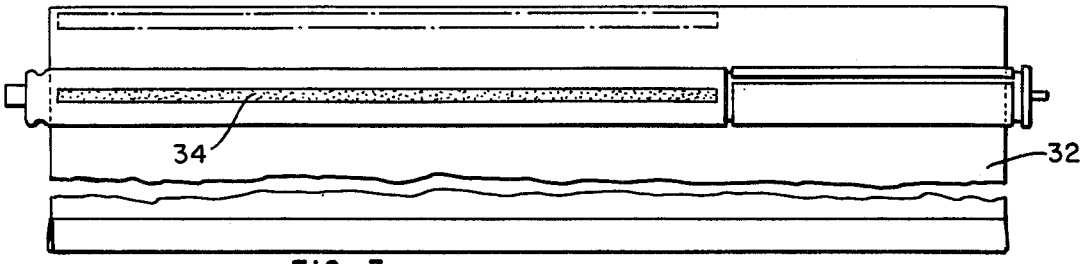
FIG. 3
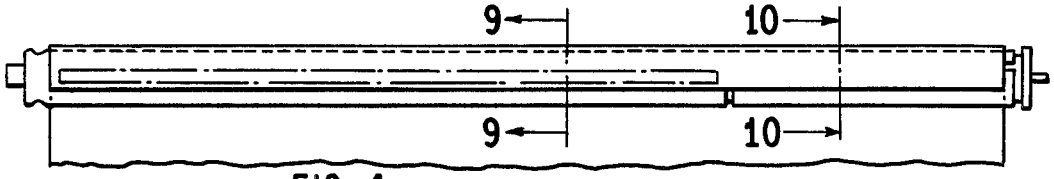
FIG. 4
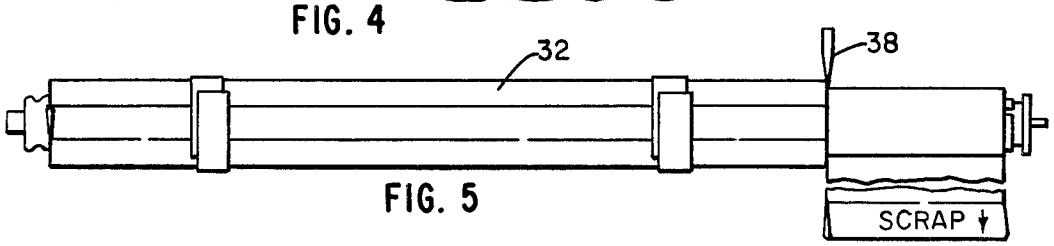
FIG. 5
FIG. 6
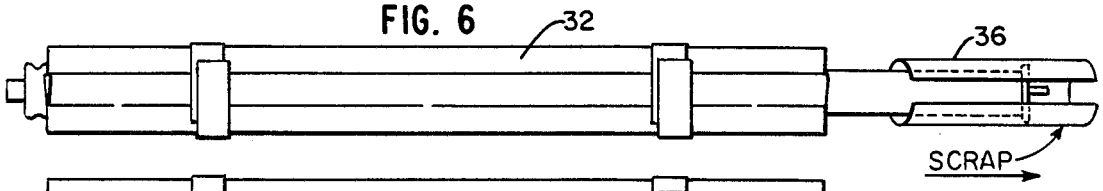
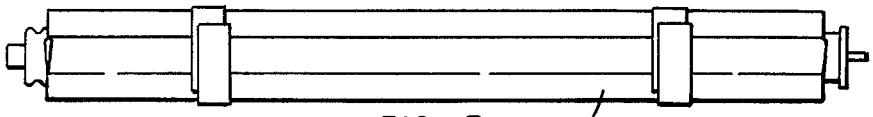
FIG. 7
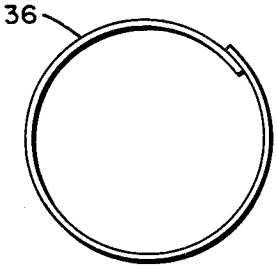
FIG. 8
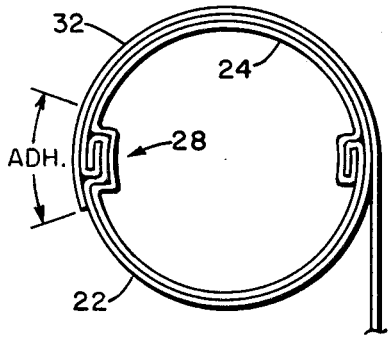
FIG. 9
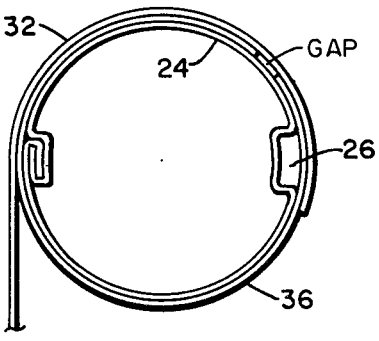
FIG. 10

SEMI-ADJUSTABLE SHADE AND ROLLER COMBINATION

FIELD OF THE INVENTION

This invention relates to roller shades and more particularly to flexible but essentially non-stretchable shades of the impregnated cloth or filament reinforced plastic types. Still more particularly it relates to arrangements for facilitating the trimming and adjusting thereof while maintaining accurate vertical tracking.

BACKGROUND OF THE INVENTION

One problem with roller shades is vertical tracking, i.e., making the shade roll up accurately on the roller. This problem is not particularly serious with stretchable shade material such as PVC. Thus, despite the use of telescoping rollers having different outside diameters, PVC shades will track well without difficulty. This is not the case, however, with essentially non-stretchable sheet material such as impregnated cloth or filament reinforced plastic. With such materials, if the tracking starts off line by even a slight amount, the shade will roll up off line, cause harmful binding on one side margin, and present an unsightly, tipped bottom margin. The most common cause of faulty tracking is variation in the outside diameter of the shade-supporting roller and since there are advantageous of ease of adjustment in using telescoping rollers, the artisans have been interested for many years in providing telescoping shade rollers with ways to compensate for the differences of diameter, so that the shade will track accurately. For example, an early patent to Rice (U.S. Pat. No. 1,898,686) provided the smaller roller section with an enlarged end for this purpose. Gossling in one case (U.S. Pat. No. 3,203,468) provided a cylindrical fiber tube around the smaller roller section to make up for the difference in diameter, and Miller (U.S. Pat. No. 4,102,385) provided an extra length of shade material to wrap around the smaller roller section small enough to make up for the diameter difference.

There have been problems, however, with these prior approaches. For example, with Gossling, the portion of the fiber tube which is cut off must be slid off the end of the smaller roller. This means that the smaller roller cannot be provided with an enlarged flanged head. This is a disadvantage because the inner roller can be pushed too far in if it has no enlarged flanged head on it. The problem with the Miller approach is that, when lock-seam tubes are used, the smaller roller will necessarily have a groove on its surface and the material of the final several wraps of the shade will depress into the groove such that the trimming knife cannot reach it. This is a nuisance because it requires hand severing. It is, in fact, why Miller discloses using shade material which can be torn along pre-scored lines. Neither shade material of impregnated cloth, nor of filament reinforced plastic can be suitably pre-scored, but yet, such material is far more attractive than the pre-scored vinyl, and it can be accurately trimmed.

It is, therefore, a primary object of the present invention to provide a semi-adjustable shade and roller combination for essentially non-stretchable shade material, in which the shade may be mechanically trimmed conveniently accurately to width without cutting, and with which the finally trimmed and adjusted shade will vertically track perfectly. Another object is to provide such a shade and roller combination with an enlarged flanged head on the end of the inner roller to facilitate adjustment of the roller to the trimmed shade without the risk of being pushed in too far.

BRIEF DESCRIPTION OF THE INVENTION

In the accomplishment of the objects of the invention, a semi-adjustable shade of essentially non-stretchable material is mounted on a telescoping lock-seam roller combination. The top of the shade is secured to the outer telescoping roller and an extruded, essentially stiff but yet resilient vinyl split sleeve is placed on the smaller roller to make up the exact difference between the outside diameters of the inner and outer rollers. An enlarged flanged head is on the exposed end of the inner roller. The vinyl sleeve is extruded in such a way that its elastic memory causes it to spring closed onto the smaller roller.

A feature of the invention is that the split vinyl sleeve bridges the groove in the inner roller and provides a perfect replica of the outside diameter of the larger roller. In this way, perfect vertical tracking is provided for the shade in all dimensions of adjustment. Another feature is that the split vinyl sleeve supports both the shade material and itself against a trimming knife across the groove on the smaller roller such that complete machine trimming of not only the shade material, but also of the sleeve is feasible. Still another feature is that, once the trimming has been completed and shade material has been removed, the sleeve can be sprung open and removed over an enlarged flanged end of the inner roller.

BRIEF DESCRIPTION OF THE DRAWINGS

A preferred embodiment of the invention selected for purposes or illustration is showing the accompanying drawings in which:

FIG. 1 is a view in front elevation of the telescoping shade roller in the invention not showing the details of the lock-seam construction;

FIG. 2 is a perspective view of the split sleeve of the invention;

FIG. 3 is an exploded view in front elevation of the telescoping roller of FIG. 1 with adhesive on the outer roller section, the split sleeve of FIG. 2 on the inner roller section, and the top margin of a shade behind but in position ready for securement to the roller by the adhesive;

FIG. 4 is a view similar to FIG. 3 but with the top of the shade rolled over and secured to the outer roller;

FIG. 5 is a view similar to FIG. 4 but with the shade fully rolled up and a cutter shown trimming a portion off the right-hand margin of the shade;

FIG. 6 is a view similar to FIG. 5, but with the trimmed portion of the shade removed, the split sleeve severed at the same point and the severed portion of the split sleeve being removed;

FIG. 7 is a view similar to FIG. 6 but with the sleeve fully removed and the inner roller pushed in;

FIG. 8 is a cross sectional view (without hashmarks because the element is so thin that hashmarks would be confusing) of the split sleeve taken along the line 8—8 of FIG. 2;

FIG. 9 is a cross sectional view (again without hashmarks for the same reason) of the telescoping roller and shade combination taken along the line 9—9 of FIG. 3; and FIG. 10 is a cross sectional view (again without hash-marks for the same reason) of the inner roller sleeve and shade, taken along the line 10—10 of FIG. 3.

DETAILED DESCRIPTION OF THE INVENTION

The preferred embodiment of the present invention herein shown for illustrative purposes comprises a telescoping roller indicated generally at 20 consisting of an outer roller 22, and an inner roller 24. Both rollers are of sheet metal and formed into a tube by lock-seaming. They are dimensioned so that the inner roller 24 fits into the outer roller 22 in smooth sliding relation. The lock-seam on both rollers is rolled inwardly as is standard practice, but this requires the inner roller 24 to be formed with a longitudinally extending groove 26 (see FIG. 10) so as to receive the inwardly extending folds of the lock-seam of the outer roller 22 as is indicated at 28 in FIG. 9. An enlarged flanged head 30 is provided for the exposed end of inner roller 24.

Telescoping roller 10 is intended to support a shade 32 having conventional top, bottom and side margins. The material of the shade is an essentially flexible but non-stretchable sheet material such as impregnated and calendered cloth, or fiberglass filament reinforced plastic. Such sheet material is, of course, slightly stretchable as are all materials, but non-stretchable in the sense that, in the context of a roller shade they must be supported on a roller of uniform diameter along its full length or else it will not vertically track properly.

The length of the shade is a standard 72 inch dimension which will equal or exceed most windows. Therefore, no trimming of the length of the shade is contemplated. Window widths, however, vary widely and it is, therefore, expected that accurate width trimming to any desired size will be required. To accommodate such width trimming, the shade of the present invention will be made in several standard width increments of say 37¼", 46¼", 55¼", and 73¼"; and that exact trimming will be employed to reduce the shade between such increments. The rollers 10, of course, will be dimensioned to fit the standard width increments of the shade and to accommodate the trimming of the shade in between. Thus, for a given standard shade width increment, outer roller 22 must be no longer in length than the next narrower shade width increment. Also, inner roller 24 must be long enough to fit sufficiently into roller 22 for good support and to extend outwardly thereof at least enough to make the overall length of roller 10 equal the given standard width increment of the shade 32. In this way, the roller can be adjusted to fit all widths to which the shade 32 may be trimmed between one standard width increment and the next narrower one.

The outside diameter of the telescoping roller 20 is made uniform along its entire length by means of a split sleeve 36 (see FIG. 2). Sleeve 36 is made of extruded PVC of a hardware selected to render it stiff but resilient. The diameter of the sleeve 36 is selected to be the same as the outside diameter of the inner roller 24 less 1/32", and to have a thickness such that when it is on the inner roller 24, its outside diameter equals that of outer roller 22. Also, the split in sleeve 36 is formed during the extrusion in such a way that the vinyl collapses slightly before cooling, at a position which imparts an elastic memory into the vinyl and causes sleeve 36 to close onto inner roller 24 with mild residual spring compression.

The top margin of shade 32 is secured to outer roller 22 by an adhesive strip 34 and the shade is rolled up overlying but not secured to sleeve 36.

In operation, the user starts with a shade having a standard width increment greater than the desired width of the shade, and trims it in a conventional shade cutter, the knife 38 only of which is illustrated. First the shade material is cut off and scrapped. During this operation, the sleeve 36 supports the shade material across the gap of groove 26 and knife 38 effectively severs the entire undesired end of the shade. Next, the knife severs the undesired end of split sleeve 36 which is than sprung open and slid off the end of inner roller 24 over enlarged flanged head 30. Finally, inner roller 24 is pushed in and the shade is ready for use. Since the effective diameter of the roller assembly is exactly the same along its entire length, the non-stretchable shade tracks properly vertically, and since the inner roller 24 is provided with enlarged flanged head 30, there is no fear of its being pushed in too far.

From this description of a preferred embodiment of the invention, it will now be apparent to those skilled in the art that various modifications will be feasible, and, therefore, it is not intended to confine the invention to the precise form herein shown but rather to limit it solely as defined in the appended claims.

I claim:

1. A semi-adjustable roller shade, comprising:

(a) a sheet of essentially flexible but non-stretchable material in the form of a shade cut to the width of a given one of several standard width increments, having top, bottom, and side margins;

(b) a telescoping roller assembly comprising:

an outer roller of sheet metal formed into an essentially uniform cylindrical shape on its outer surface with a lock-seam of several thicknesses of said metal extending inwardly on the inner surface thereof, and an inner roller of sheet metal formed into a cylindrical shape and dimensioned to fit into said outer roller in smooth sliding telescoping relation, and with a longitudinal groove in the outer surface thereof dimensioned to receive the lock-seam of the outer roller;

(c) the length of the outer roller being slightly less than the width of a shade of the next narrower width increment, and the length of the inner roller being substantially more than the width dimensional difference between said given one standard width and said next narrower standard width;

(d) said inner roller positioned in said outer roller and extending outwardly thereof sufficiently to make the length of said roller assembly at least equal to said given one standard width;

(e) the top margin of said shade connected to said larger roller;

(f) a split sleeve of essentially stiff but resilient sheet material having a thickness equal to the difference in outside diameter between said outer and inner rollers, mounted on said inner roller;

(g) a flanged head having an outside diameter greater than the outside diameter of the outer roller mounted on the end of the inner roller opposite the outer roller such that said sleeve is held between the outer roller and the flanged head; and (h) the shade rolled up on said roller assembly, whereby the side margin of said shade overlying said split sleeve may be cut to give the shade a desired width between said one given standard width and the next narrower standard width with said sleeve supporting said shade material for cutting across the groove in said inner roller, and whereby said sleeve may then also be cut and sprung open to remove the cut portion from the inner roller, with enlarged flanged head, and the inner roller may then be pushed in without risk of pushing it in too far to provide a trimmed shade of the desired width.

2. The semi-adjustable roller shade of claim 1 further characterized by:

the sleeve made of extruded plastic to provide an elastic memory for said sleeve to seek a diameter of substantially less than the outside diameter of said inner roller.

3. A semi-adjustable roller shade, comprising:

(a) a sheet of shade material having top, bottom, and side margins;

(b) a telescoping roller assembly comprising:

an outer roller in an essentially cylindrical shape; and an inner roller in an essentially cylindrical shape and dimensioned to fit into said outer roller in smooth sliding telescoping relation;

(c) the length of the outer roller being less than the width of the shade and the length of the inner roller being substantially more than the width dimensional difference between said width and said next narrower standard width;

(d) said inner roller positioned in said outer roller and extending outwardly thereof sufficiently to make the length of said roller assembly at least equal to said shade width;

(e) the top margin of said shade connected to said larger roller;

(f) a flanged head of greater diameter than the outer diameter of the outer roller mounted on the end of the inner roller opposite the outer roller;

(g) a split sleeve of essentially stiff but resilient sheet material having a thickness equal to the difference in outside diameter between said outer and inner rollers, mounted on said inner roller between the outer roller and the flanged head; and (h) the shade rolled up on said roller assembly, whereby the side margin of said shade overlying said split sleeve may be cut to give the shade a desired width between said one given standard width and the next narrower standard width with said sleeve supporting said shade material for cutting across the groove in said inner roller, and whereby said sleeve may then also be cut and sprung open to remove the cut portion from the inner roller, over the flanged head, and the inner roller may then be pushed in without risk of pushing it in too far to provide a trimmed shade of the desired width.

4. The semi-adjustable roller shade of claim 3 further characterized by:

the sleeve made of extruded plastic to provide an elastic memory for said sleeve to seek a diameter less than the outside diameter of said inner roller.

* * * * *